United States Patent [19]

Milliens

[11] Patent Number: 4,482,090

[45] Date of Patent: Nov. 13, 1984

[54] PACKAGE SLEEVE WITH GUSSET PANEL FOR TIGHTENING SLEEVE AND REINFORCING A HANDLE

[75] Inventor: Andre Milliens, Etrechet, France

[73] Assignee: The Mead Corporation, Dayton, Ohio

[21] Appl. No.: 463,463

[22] Filed: Feb. 3, 1983

[30] Foreign Application Priority Data

Jan. 27, 1982 [GB] United Kingdom ..... 8202361

[51] Int. Cl.[3] ..... B65D 5/46; B65D 5/02

[52] U.S. Cl. ..... 229/40; 206/427; 229/52 B

[58] Field of Search ..... 229/40, 37 R, 52 B, 229/DIG. 3; 285/236; 206/83.5, 427, 434

[56] References Cited

U.S. PATENT DOCUMENTS

| | | | |
|---|---|---|---|
| 1,789,699 | 1/1931 | Durham | 229/DIG. 3 |
| 1,846,584 | 2/1932 | Clark | 206/83.5 |
| 2,312,598 | 3/1943 | Sprague | 229/52 B |
| 2,628,764 | 2/1953 | Rubinstein | 229/DIG. 3 |
| 3,228,714 | 1/1966 | Dricken | 285/236 |
| 3,255,950 | 6/1966 | Marcauly | 229/52 B |
| 3,297,232 | 1/1967 | Fesco | 229/DIG. 3 |
| 3,554,402 | 1/1971 | Lock | 229/52 B |
| 3,672,558 | 6/1972 | Johnson | 229/37 R |
| 3,695,508 | 10/1972 | Hocking | 229/DIG. 3 |
| 3,904,036 | 9/1975 | Forrer | 229/40 |
| 3,994,432 | 11/1976 | Kirby | 229/52 B |
| 4,331,289 | 5/1982 | Killy | 229/37 R |

FOREIGN PATENT DOCUMENTS

| | | | |
|---|---|---|---|
| 54311 | 11/1942 | Denmark | 229/DIG. 3 |

*Primary Examiner*—William Price
*Assistant Examiner*—Gary E. Elkins
*Attorney, Agent, or Firm*—Erwin Doerr

[57] ABSTRACT

This invention relates to a fully enclosed packaging case (c) for packaging a group of articles such as bottles. The case comprises a sleeve (10) formed from paperboard or similar sheet material and which includes end closure panels (20, 22, 28, 30, 32) at each of its ends, the sleeve being adapted for tightening about the group of articles, the tightening being accomplished by providing a gusset panel (46) in the top wall (12) of the sleeve. The gusset panel is folded downwardly and secured in overlapping relationship with the underside of an adjacent part of the top wall during the packaging operation so as to reduce the circumference of the sleeve. As a result a three-ply strip of material is provided by two adjacent portions of the top wall with the gusset panel disposed therebetween so providing a strong handle area for the package.

4 Claims, 6 Drawing Figures

PACKAGE SLEEVE WITH GUSSET PANEL FOR TIGHTENING SLEEVE AND REINFORCING A HANDLE

This invention relates to a fully enclosed packaging case for accommodating a group of articles such as bottles.

One aspect of the present invention provides a sleeve for forming a packaging case, which sleeve is formed from paperboard or similar sheet material and includes end closure panels at each of its opposite ends, the sleeve including means whereby its circumference can be reduced, so as to tighten the sleeve about a group of articles accommodated therein, characterized in that said means comprises a gusset panel located between and hinged to adjacent portions of a top panel of the sleeve, and in that said gusset panel is foldable about its hinged connections to effect said tightening so as to bring said adjacent portions of the top panel into overlapping relationship with the gusset panel disposed therebetween.

Another aspect of the invention provides a blank for forming a sleeve according to the immediately proceeding paragraph.

Yet another aspect of the invention provides a packaging case formed from a sleeve according to the first mentioned aspect of the invention.

A further aspect of the invention provides a packaging case comprising a top wall a first side wall a bottom wall and a second side wall hinged one to the next thus forming a tubular structure, a set of end closure panels hinged to and closing opposite ends of the tubular structure, characterized in that said top panel comprises a pair of similar panel portions having adjacent ends located in overlapping relationship and a gusset panel hinged to each of said adjacent ends and disposed between the overlapped parts of said top panel portions.

An embodiment of the invention will now be described, by way of example, with reference to the accompanying drawings, in which.

Figure 1:
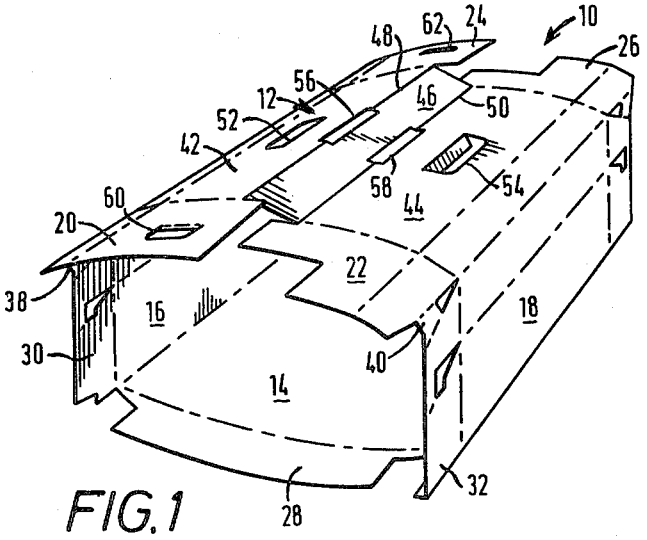
FIG. 1 is a perspective view of the sleeve viewed from one end.

Referring to the drawings, there is shown a sleeve 10 formed from paperboard or similar foldable sheet material and which comprises a top panel 12, a bottom panel 14 and side walls 16, 18 respectively hinged one to the next so as to form a tubular sleeve.

Figure 2:
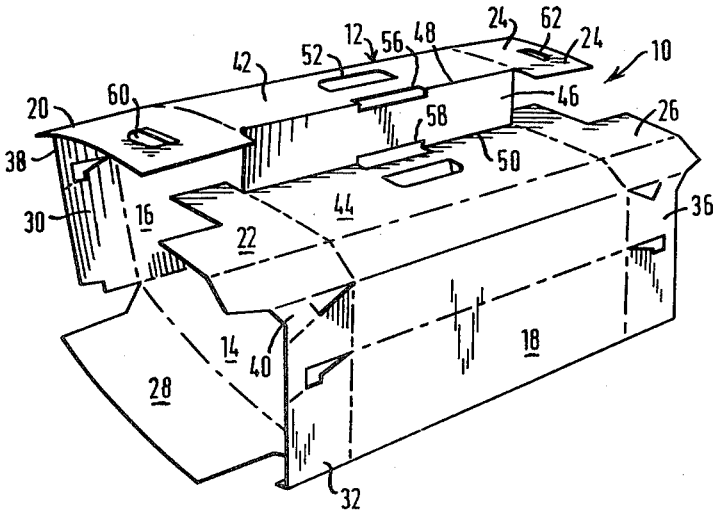
FIG. 2 is a perspective view of the sleeve viewed from one side.

End closure panels are formed at each end of the sleeve 10 and comprise top end closure panels 20, 22 hinged at one end of the sleeve to the top panel 12 and top end closure panels 24, 26 hinged at the opposite end of the sleeve to the top panel 12. Further end closure panels comprise a bottom end closure panel 28 hinged at one end of the sleeve to the bottom panel 14 and a similar bottom end closure panel (not shown) hinged at the opposite end of the sleeve to the bottom panel 14. Side end closure panels 30, 32 are hinged at one end of the sleeve to side walls 16 and 18 respectively and a similar pair of side end closure panels 34, 36 are hinged at the opposite end of the sleeve also to side wall panels 16 and 18 respectively. As best seen in FIGS. 1 and 2 the side end closure panels 30 and 32 are hinged to the top end closure panels 20 and 22 by means of integral web panels 38 and 40 respectively, and a similar construction is provided at the opposite end of the sleeve.

The top panel 12 comprises a pair of panel portions 42 and 44 which are integrally connected together by a gusset panel 46 which is hinged to the top panel portions 42 and 44 along axially extending fold lines 48 and 50 respectively.

Figure 4:
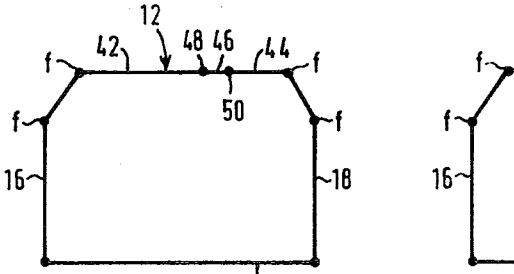
FIGS. 4 to 6 are schematic views showing folding of the gusset panel in order to reduce the circumference of the sleeve.

The sleeve is shown in its open position ready for filling with a group of articles such as bottles in FIGS. 1 and 4. In this position the gusset panel 46 is located substantially in the plane of the top panel portions 42 and 44 respectively. Of course, in this position the sleeve is at maximum circumference providing the largest possible opening at each of its ends to facilitate loading.

Figure 5:
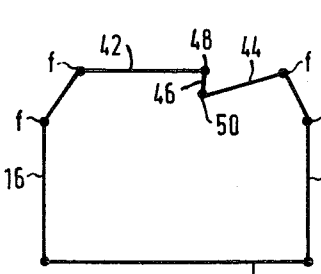
Figure 6:
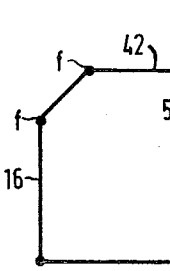

Once the loading operation has been completed, and before the end closure panels of the sleeve are folded in order to close the ends and provide a fully enclosed packaging case, the gusset panel 46 is folded vertically downwardly about fold lines 48 and 50 respectively as shown in FIGS. 2 and 5 of the drawings which results in an inward and downward displacement of top panel portion 44 relative to the top panel portion 42. The folding operation is continued so that the gusset panel and the top panel portion 44 is moved upwardly into a substantially horizontal position whereby adjacent edges of the top panel portions 42 and 44 are brought into overlapping relationship with the gusset panel 46 superposed thereinbetween. This position is shown in FIG. 6 of the drawings. It will be appreciated that this folding operation which is in the nature of a 'toggle action' has the effect of reducing the overall circumference of the sleeve in order to tighten the panels about the articles accommodated therein.

Where the articles are bottles it is desirable that the sleeve has side walls which slope inwardly as in the embodiment shown. This is easily achieved simply by providing appropriate fold lines as designated 'f' adjacent top portions of the side walls as is well known in the packaging art.

Naturally, in order to secure the sleeve in its tightened configuration the folding operation normally is preceded by a glueing operation in which an application of glue is made to both surfaces of the gusset panel 46 or alternatively to those areas of the top panel portions 42 and 44 which are to be brought into overlapping relationship with the gusset panel 46.

In order to complete the packaging case 'c' the end closure panels at each end of the sleeve are folded inwardly about their respective fold lines, and brought into and secured overlapping relationship as is well known.

Figure 3:
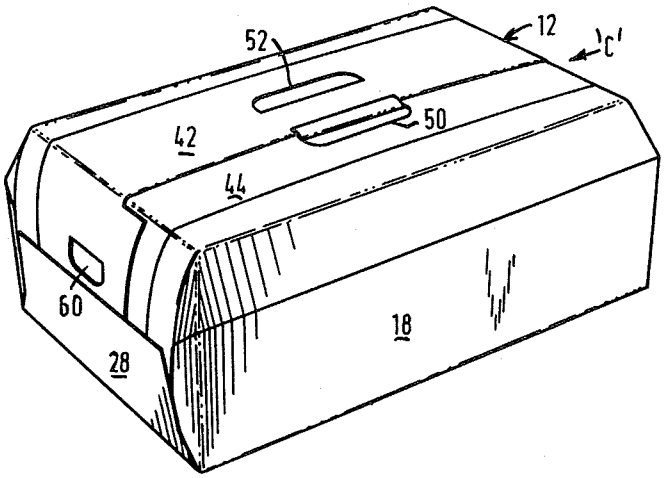
FIG. 3 is a perspective view from above and to one side showing the completed packaging case.

The completed package 'c' is shown in FIG. 3 of the drawings.

In order to provide for portage of the package each of the top panel portions 42 and 44 are provided with hand gripping apertures 52, 54 respectively and similar hand gripping apertures 56 and 58 are provided along the fold lines 48, 50 of the gusset panel 46. Hence, when the sleeve is brought into its reduced circumference configuration hand gripping apertures 52 and 58 and 56 and 54 are brought into registry with one another. This construction has the advantage that a three-ply strip of material is provided in the top wall 12 of the case so providing a strong handle area for the package.

If desired, further hand gripping apertures 60, 62 may be provided in top end closure panels 20 and 24 respectively.

I claim:

1. A sleeve (10) for forming a packaging case, which sleeve is formed from paperboard or similar sheet material and includes end closure panels (20, 22, 28, 30, 32; 24, 26) at each of its opposite ends, the sleeve including means whereby its circumference can be reduced so as to tighten said sleeve about a group of articles accommodated therein, said means comprising a gusset panel (46) interconnecting and hinged to adjacent panel portions (42, 44) forming a top panel (12) of the sleeve, said gusset panel (46) being foldable about its hinged connections (48, 50) from a first position in which it lies intermediate of and in substantially the same plane as said adjacent portions of the top panel into a second position in which said adjacent portions of the top panel are in overlapping relationship with said gusset panel disposed therebetween, and first hand gripping apertures (52, 54) disposed in said top panel portions (42, 44) adjacent to said hinged connections with said gusset panel (46), and second hand gripping apertures (56, 58) positioned at said hinged connection of said gusset panel and aligned with said first hand gripping apertures so that said first and second hand gripping apertures (52, 54; 56, 58) are brought in registry with one another when said gusset panel is folded into said second position.

2. A sleeve according to claim 1, further characterized in that said gusset panel is located centrally of said top panel portions.

3. A sleeve according to claim 2, further characterized in that said gusset panel extends from one end of the top panel to the opposite end thereof in the direction of the main axis of the sleeve.

4. A sleeve in accordance with claim 1, further characterized in that said end closure panels at each end of the sleeve comprise a first top end closure panel (20) hinged to one of said top panel portions (42), a second top end closure panel (22) hinged to the other of said top panel portions (44), and a pair of side end closure panels (30, 32) hinged to respective ones of a pair of side walls (16, 18) of the sleeve, said first and second top end closure panels being configured so as to overlap when the adjacent portions of the top panel are in said second position.

* * * * *